US005224856A

United States Patent [19]

Nakamura

[11] Patent Number: 5,224,856

[45] Date of Patent: Jul. 6, 1993

[54] SURFACE COMBUSTION BURNER

[75] Inventor: Sunao Nakamura, Tokyo, Japan

[73] Assignee: Nippon Kokan Kabushiki Kaisha, Tokyo, Japan

[21] Appl. No.: 967,538

[22] Filed: Oct. 27, 1992

Related U.S. Application Data

[63] Continuation of Ser. No. 768,079, filed as PCT/JP91/00122, Jan. 31, 1990, abandoned.

[30] Foreign Application Priority Data

Jan. 31, 1990 [JP] Japan ..... 2-18956

[51] Int. Cl.[5] ..... F23D 14/12

[52] U.S. Cl. ..... 431/328; 126/92 AC

[58] Field of Search ..... 431/326, 327, 328, 329; 126/92 R, 92 AC, 92 B, 91 R

[56] References Cited

U.S. PATENT DOCUMENTS

| | | | |
|---|---|---|---|
| 689,327 | 12/1901 | Sarafian | 431/329 |
| 3,269,449 | 8/1966 | Witten, Jr. | 431/328 |
| 3,485.230 | 12/1969 | Harrington et al. | 126/92 |
| 3,722,866 | 3/1973 | Herzberg | 432/175 |
| 3,857,669 | 12/1974 | Smith et al. | 431/328 |
| 4,735,568 | 4/1988 | Izumisawa et al. | 431/325 |
| 4,766,877 | 8/1988 | Jensen et al. | 126/92 AC |
| 4,977,111 | 12/1990 | Tong et al. | 431/329 |
| 5,161,965 | 11/1992 | Nakamura | 431/328 |

FOREIGN PATENT DOCUMENTS

| | | | |
|---|---|---|---|
| 148639 | 12/1975 | Japan | 431/326 |
| 3-28608 | 2/1991 | Japan . | |
| 3-28609 | 2/1991 | Japan . | |
| 3-28610 | 2/1991 | Japan . | |
| 3-28611 | 2/1991 | Japan . | |
| 3-28612 | 2/1991 | Japan . | |
| WO89/12784 | 12/1989 | World Int. Prop. O. | 431/326 |

*Primary Examiner*—James C. Yeung

*Attorney, Agent, or Firm*—Jacobson, Price, Holman & Stern

[57] ABSTRACT

A surface combustion burner of a plural layer structure made by laminating a layer of a burning resisting material such as a ceramic material and a supporting layer such as a metal fiber mat. There are provided a first layer (1) made of a material having a burning resisting property and forming a gas combustion zone and a second layer (2) for supplying a gas to the first layer and supporting the first layer, and further provided between the first and second layers is a third layer (3) which is joined with the first layer by sewing with a burning resisting thread (4) and which is bonded to the second layer by sintering.

4 Claims, 4 Drawing Sheets

SURFACE COMBUSTION BURNER

This application is a continuation of application Ser. No. 07/768,079, filed as PCT/JP91/00122, Jan. 31, 1990, now abandoned.

TECHNICAL FIELD

The present invention relates to a surface combustion burner and more particularly to a surface combustion burner of a plural layer structure which is constructed by laminating a layer of a burning resisting material such as a ceramic material for forming a gas combustion zone and a supporting layer such as a metal fiber mat.

BACKGROUND ART

Among infrared heating apparatus whose application is expected in a wide range of fields such as cooking and heating of foods and drying of coated products, etc., a surface combustion burner is known as one of techniques which employ as a heat source thereof a gas fuel that is low in cost and high in calories.

The surface combustion burner is such that the heat energy of a combustion gas, which is largely taken out by convection in the case of the ordinary combustion, is efficiently converted to a radiant heat and it is designed so that a mixture or a premix of air and a gas fuel is supplied from one side of a permeable sheet member ( hereinafter referred to as a burner diaphragm ) and the mixture is burned in the surface layer portion on the other side of the burner diaphragm, thus heating the surface layer portion itself of the burner diaphragm and thereby causing it to discharge the radiant heat. Thus, in the surface combustion burner the combustion of the gas is maintained in a condition where a flame is brought into close contact with the surface of the burner diaphragm or entered into the surface layer portion and the radiant heat is radiated from the flame and the burner diaphragm surface layer portion heated to a red hot state.

With the conventional surface burners, those of the type in which a porous sintered metal sheet or sintered ceramic sheet is used as a raw material for its burner diaphragm have already been put in practical use in some fields such as cooking utensils and others using a fiber mat composed of metal or ceramic fibers sintered in layer form have been studied vigorously. These surface combustion burners are advantageous in that in addition to the fact that a radiant heat can be obtained with high efficiency, a stable combustion is possible which is not dependent on the external environments such as wind and temperature. Particularly, since the burner diaphragm composed of a mat made by sintering stainless steel fibers can be formed to have a complicated surface shape and its strength is excellent and since the realization of a high-porosity structure makes it possible to easily manufacture a burner which is large in area, low in pressure loss, high in combustion degree and high in power output density and which is relatively inexpensive, its application to such uses as a heating apparatus at an outdoor job site and the baking and drying of automobile painting is expected.

FIG. 3 is a schematic diagram showing the construction of an infrared heater used at an outdoor job site as an example of a surface combustion burner apparatus using a burner diaphragm made of a stainless steel fiber mat, and its principal part including the burner diaphragm is shown in section.

In FIG. 3, the burner diaphragm m is composed of a stainless steel fiber mat of 5 mm thick which is made by forming stainless steel ( JIS-SUS 316 ) long fibers of 20 μm in diameter and about 50 mm in length into a mat shape and sintering the long fibers together. With this burner diaphragm m, its surface layer portion ml forms a gas combustion zone during the operation of the apparatus and this gas combustion zone is a radiant heat radiation portion.

Here, a fuel gas supply system including a gas nozzle N, a solenoid valve SV and a fuel gas bomb T and an air supply system including an air blower or fan F are connected to a burner proper K to which the burner diaphragm m is attached. In addition, a spark electrode S for ignition purposes is arranged in opposition to the lower end of the burner diaphragm m so that when its switch is operated, a controller C not only brings the solenoid valve SV and the blower F into operation but also applies a spike-like high voltage between the spark electrode S and the burner diaphragm m thus producing a discharge spark and thereby igniting the gas-air mixture at the surface of the burner diaphragm m. These component members are mounted on a movable base B which is equipped with wheels.

Then, when the switch of the controller C is operated so that the heating apparatus is started, the solenoid valve SV is opened causing the injection of the fuel gas through the nozzle N and also the blower F is started thus supplying air whereby inside the burner proper K the resulting mixture of the fuel gas and the air flows toward and passes through the burner diaphragm m thereby soaking out to the outside through the surface layer portion ml. On the other hand, a spark is produced between the spark electrode S and the burner diaphragm m across which a high voltage has been applied so that the air-gas mixture soaking out to this portion is ignited and a flame is rapidly propagated all over the surface of the burner diaphragm thereby starting the burning operation.

At this time, in order that this surface combustion burner may effect an efficient combustion, the amount of gas supply and the amount of air supply must be controlled exactly. In other words, the ratio of the amount of gas supply to the amount of air supply ( the mixture ratio ) is made substantially equivalent to a chemical reaction stoichiometric amount ratio and also the flow rate of the gas-air mixture passing through the burner diaphragm m is selected to be in such a range that the flame does not get off the surface of the burner diaphragm m. As a result, the stable combustion is maintained in the surface layer portion ml of the burner diaphragm and the surface layer portion ml is heated red hot, thereby radiating a radiant heat in an amount substantially dependent on the surface temperature of the surface layer portion ml.

PROBLEMS THAT THE INVENTION IS TO SOLVE

In the case of the surface combustion burner employing the burner diaphragm made of a stainless steel fiber mat, the progress in the oxidation deterioration of the burner diaphragm surface layer portion heated red hot is so remarkable that the stainless steel fiber mat is rapidly thinned out thus leading to breaking and the life of the burner diaphragm is decreased; therefore, as for example, in the case of the burner diaphragm of the conventional heater, the life has never exceeded 100 hours even in the ordinary operation.

FIG. 4*a* shows a temperature distribution in the thickness direction of the burner diaphragm m when the conventional surface combustion burner performed the ordinary operation. In FIG. 4*a*, the abscissa represents the internal depth position D[mm] of the burner diaphragm m with the surface of the surface layer portion ml as the origin (O) and the ordinate represents the temperature T[°C.]. FIG. 4*b* shows the respect to the depth of the diaphragm.

In FIG. 4*a*, the temperature at the surface of the surface layer portion ml of the burner diaphragm m is as high as about 1200° C. and this is a severe environment for this kind of stainless steel fiber mat whose normal temperature is desired to be maintained lower than about 800° C. On the other hand, since the stainless steel fiber mat itself is a material which is relatively low in heat conductivity and it is always cooled by the unburned gas-air mixture passing therethrough, as the position becomes closer to the back side from the surface layer portion ml, the temperature is decreased rapidly so that even in FIG. 4*a* the temperature is in fact below 800° C. at the internal position of only 1 mm from the surface of the surface layer portion ml and here the temperature is such that it is satisfactorily withstood by the stainless steel fiber mat.

Nothing this point, the inventor has attempted to produce a burner diaphragm of a two-layer structure by replacing the surface layer portion ml of the burner diaphragm m with a mat of a heat resisting material, e.g., a sintered burning resisting material such as $Al_2O_3$ ceramic fibers, using the remainder, i.e., the back side excluding the surface layer portion as a supporting layer for the stainless steel fiber mat and bonding the heat resisting material mat and the stainless steel fiber mat together by sintering. However, the stainless steel fibers and the heat resisting material fibers differ considerably with respect to the essential conditions for sintering, that is, the stainless steel fibers will be melted under the required temperature condition for the sintering of the heat resisting material fibers and so on and thus it is now apparent that it is difficult to bond the two mats by sintering. Also, while attempts have been made to replace the bonding by sintering by means of arranging a large number of small heat resisting screws at the combustion surface, penetrating the screws through the two layers and fastening the screws on the back side, the actual combustion tests conducted have shown that oxidation deterioration of the stainless steel fiber mat proceeds more severely than the remainder, particular at those portions along the small heat resisting screws penetrating through the burner diaphragm and eventually it results in the formation of a gap around each of the small heat resisting screws, thereby deteriorating the uniformity of the flow rate and combustion of the gas-air mixture at the combustion surface.

On the other hand, it has been confirmed that if a large-area burner diaphragm is made with the bonding between the two layers being left insufficient, a partial gap is formed between the layers thus disturbing the flow of the air-gas mixture and making the combustion unstable and nonuniform, and that as the result of the repeated operations the relatively thin ceramic fiber mat layer collapses and falls off due to the difference in thermal expansion between the two layers

DISCLOSURE OF INVENTION

It is the primary object of the present invention to provide a surface combustion burner having a long life, which is so designed that the heat resistance of a burner diaphragm is enhanced by making its surface layer portion with a burning resisting material, and the layer of the burning resisting material and a layer of stainless steel fiber mat are firmly bonded without deteriorating the uniformity of gas combustion at the combustion surface.

A surface combustion burner according to a basic concept of the present invention is characterized by comprising a first layer made of a material having a burning resisting material and forming a gas combustion zone, a second layer for supplying a gas to the first layer and supporting the first layer, and a third layer arranged between the first and second layers and bonded thereto, the third layer being bonded to the first layer by sewing together with a burning resisting thread and also being bonded to the second layer by sintering.

In the surface combustion burner according to a preferred aspect of the present invention, the first layer is made of a ceramic cloth.

According to another preferred aspect of the present invention, the burning resisting thread is composed of a heat resisting metal wire, and the first and third are sewed on with stitches made with the heat resisting metal wire by a sewing machine.

In the surface combustion burner according to the present invention, a mixture prepared by premixing air and a gas is supplied from the second layer side so that the mixture passes through the second layer, soaks out to the first layer and is burned in the surface layer portion or the first layer, thereby heating the surface layer portion to a red-hot state.

Here, as for example, a burning resisting material such as a ceramic fiber mat is used for the first layer and also a stainless steel fiber mat is generally used for the second layer in consideration of strength and economy.

On the other hand, the first and third layers are bonded together by sewing and the second layer is bonded to the third layer by sintering, thereby firmly bonding the three layers to one another. In other words, the third layer is made of a material, e.g., the same stainless steel material that can be easily sintered with the second layer so that after the third layer has been sewed on the first layer, the second layer is superposed on the third layer and bonded together by sintering.

In accordance with the construction of the burner diaphragm of the present invention, the first layer has a certain thickness and the second and third layers are apart from the high-temperature combustion surface by a distance corresponding to the thickness of the first layer, thereby preventing them from being directly exposed to an elevated temperature due to the gas combustion. Also, since the second and third layers are bonded by sintering, there are no holes and heat resisting material extending through the burner diaphragm and therefore the uniformity of the flow rate and the combustion condition of the air-gas mixture at its combustion surface is maintained.

Here, while various heat resisting materials such as ceramic fiber mats, high melting-point metal fiber mats as well as woven cloths, pile fabric cloths, etc., of such materials are usable for the first layer, it is desirable to make the selection such that it has the same porosity as the materials of the second and third layers or no stepped difference or rapid variation is caused in the joining area Also, while a burning resisting material, e.g., heat resisting metal wires such as a Kanthal wire of Fe-25%, Cr-5% and Al-2% Co or a twisted thread or single-strand thread of a ceramic fiber material can be used for the thread for sewing the first and third layers together, the thickness of these threads should preferably be selected to meet the minimum required limit in terms of strength from the standpoint of making the combustion condition uniform.

In the surface combustion burner according to the present invention, if the first layer is made of a ceramic cloth, the ceramic cloth is easy to handle as compared with the ceramic fiber mat or the like and moreover there is no occurrence of any crushing or collapsing due to the sewing, thereby making it possible to join the first and third layers together by using for example the ordinary industrial sewing machine or the like.

In the surface combustion burner according to the present invention, the burner diaphragm surface layer forming its gas combustion zone is formed by the first layer of the burning resisting material and thereform the progress of oxidation deterioration of the burner diaphragm is retarded. Also, since the first layer is sewed on the third layer and the third layer is firmly bonded to the second layer by sintering, the burner diaphragm and the surface combustion burner can be manufactured and handled easily and there is less danger of causing nonuniformity of the combustion at the combustion surface due to the sewing and hence the occurrence of a partial oxidation deterioration phenomenon due to such nonuniform combustion. As a result, the life of the burner diaphragm is increased, thus making it possible to improve the utilization of the burner diaphragm and thereby to reduce the operating cost of a combustion apparatus using this burner diaphragm.

In addition, since the first and third layers are joined together by sewing, the selection of materials can be made with a considerable freedom without giving any consideration to the difference in sintering temperature and the matching as to affinity, etc., between the materials as in the case of the bonding by sintering.

As a result, not only the material cost and production cost of the burner diaphragm are reduced and its life is increased, but also it is possible to reduce the running cost of a combustion apparatus employing this burner diaphragm. Also, since there is no need to give much consideration to the heat resistance of the burner diaphragm during the operation, it is possible to use a high calory gas such as propane gas to effect a high-density surface combustion and also to set higher the surface temperature of the combustion surface, thereby obtaining a higher radiation efficiency.

The above and other objects and advantages of the present invention will become more apparent from the following description of an embodiment for purposes of illustration when taken in conjunction with the accompanying drawing.

BEST MODE FOR CARRYING OUT THE INVENTION

Figure 1A:
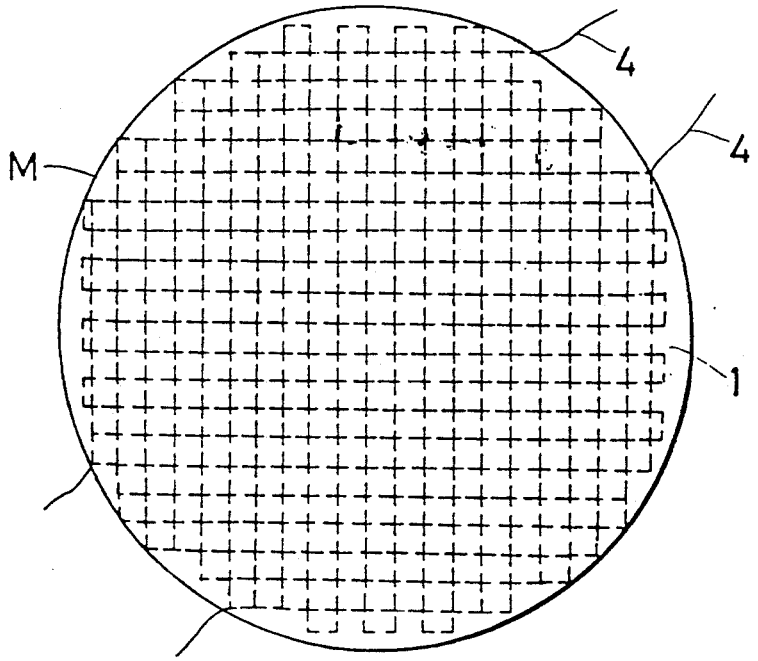
FIG. 1*a* is a front view showing the construction of a surface combustion burner according to an embodiment of the present invention.
Figure 1B:
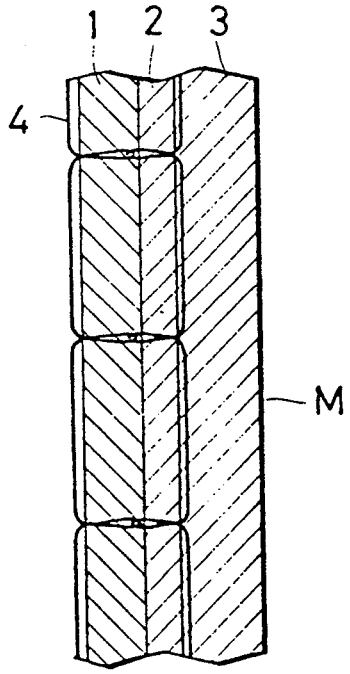
FIG. 1*b* is a partial enlarged sectional view of FIG. 1*a*.

In FIGS. 1*a* and 1*b*, the surface combustion burner according to this embodiment includes a burner diaphragm M of a three-layer structure including an ceramic cloth 1 as a first layer which is to form a surface layer portion, a stainless steel fiber mat 2 as a second layer which is to form a supporting layer, and a stainless steel fiber mat 3 as a third layer which is to be interposed between the first and second layers to effect the bonding between the two layers through it. Here, the ceramic cloth 1 forming the first layer and the stainless steel fiber mat 3 forming the third layer are sewed together with a Kanthal single-strand wire 4 as will be described in detail later, and the second and third layers are bonded together through the sintering of the stainless steel fiber mats 2 and 3 of the same material.

The first layer or the ceramic cloth 1 is a nonwoven cloth of 1 to 2 mm thick which is made of $Al_2O_3$ long fibers of 8 $\mu$m in diameter, and the second and third layers or the stainless steel fiber mats 2 and 3 are each made by combining and forming a large number of stainless steel ( JIS-SUS 316 ) fibers of 20 $\mu$m in diameter and about 50 mm in length into a mat shape and then bonding the long fibers together by sintering, with the mat 2 having a thickness of 4 mm and the mat 3 having a thickness of 0.5 mm. Also, the $Al_2O_3$ ceramic cloth 1 and the stainless steel fiber mats 2 and 3 have substantially the same porosity of 90% or over.

With this burner diaphragm M, the ceramic cloth 1 of 1 to 2 mm thick and the stainless steel fiber mat 3 of 0.5 mm thick are arranged one upon another so that the superposed two layers are sewed crosswise according to a checkerboard-like stitch pattern of about 10 mm squares with the single-strand wire of Kanthal, an iron-chromium alloy or the like, of 0.1 mm in diameter by an industrial sewing machine thereby bonding the two layers together; thereafter, the stainless steel fiber mat 2 of 0.4 mm thick is superposed on the stainless steel fiber mat 3 and the boundary surface portion of the mats 2 and 3 is sintered under the application of a pressure in a high temperature condition, thereby bonding the two together.

Figure 2:
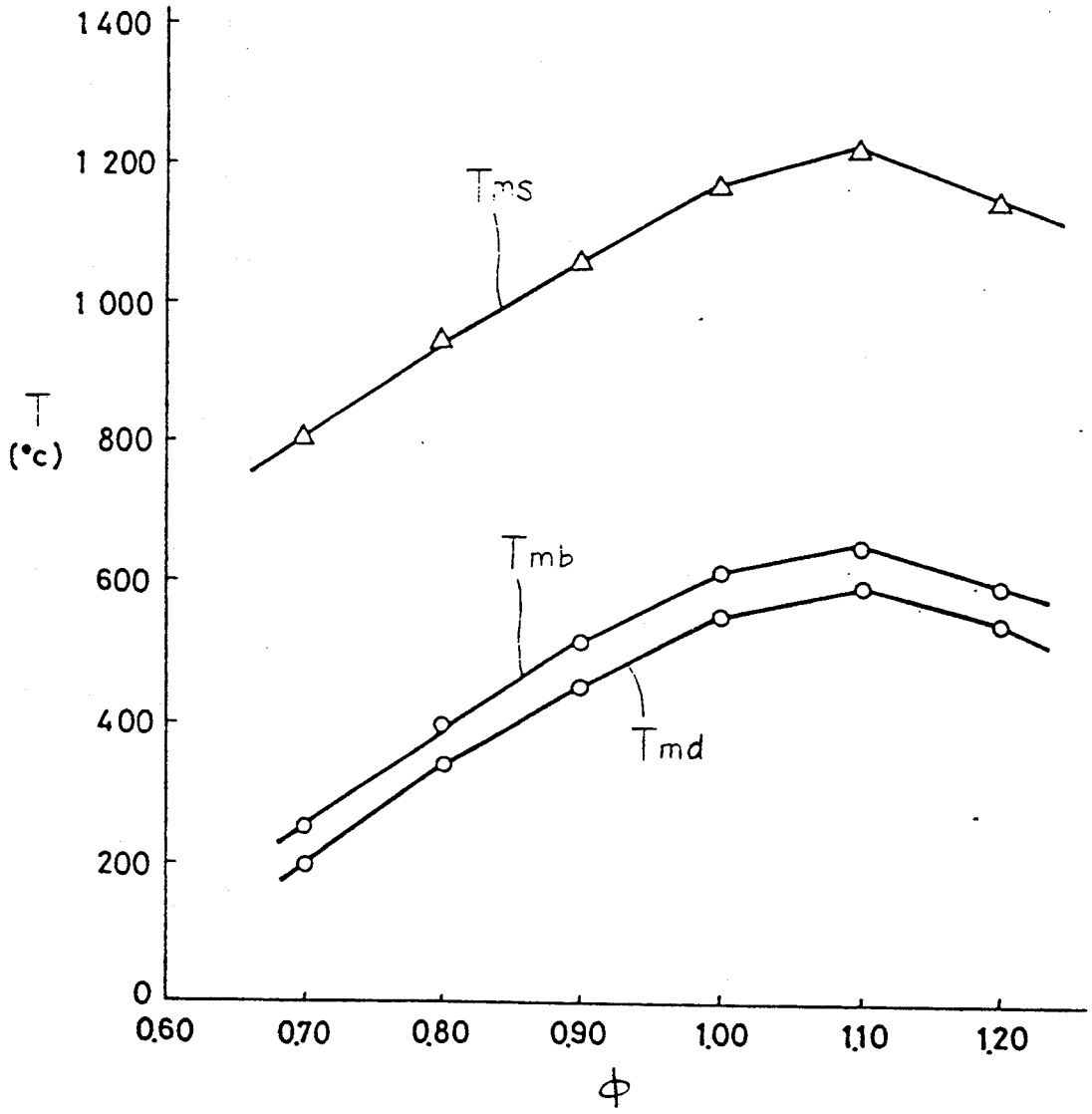
FIG. 2 is a graph showing the relation between the operating condition of the surface combustion burner according to the embodiment of the present invention and the boundary surface temperatures of the respective layers in the burner diaphragm, with the abscissa representing the equivalent amount ratio $\phi$ ( actual fuel-air ratio/stoichiometric fuel-air ratio ) and the ordinate representing the temperature T[°C.].
Figure 3:
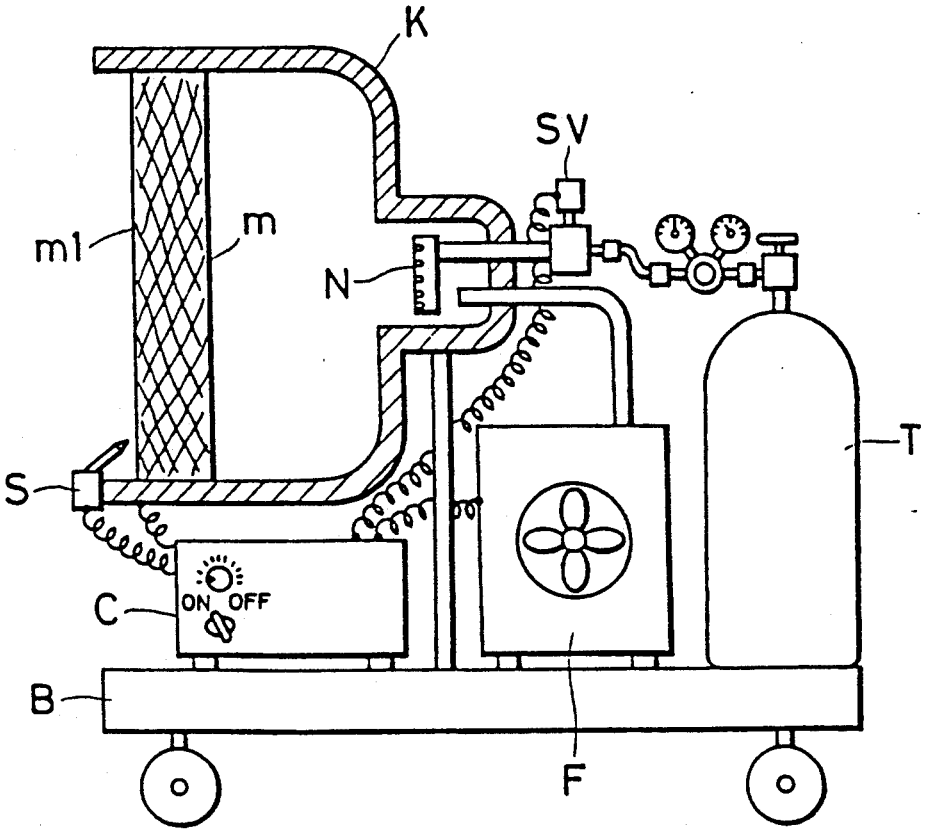
FIG. 3 PRIOR ART
FIG. 3 is a schematic diagram showing an example of the construction of a heating apparatus for outdoor operation purposes by way of an example of the applications of a conventional surface combustion burner.
Figures 4A, 4B:
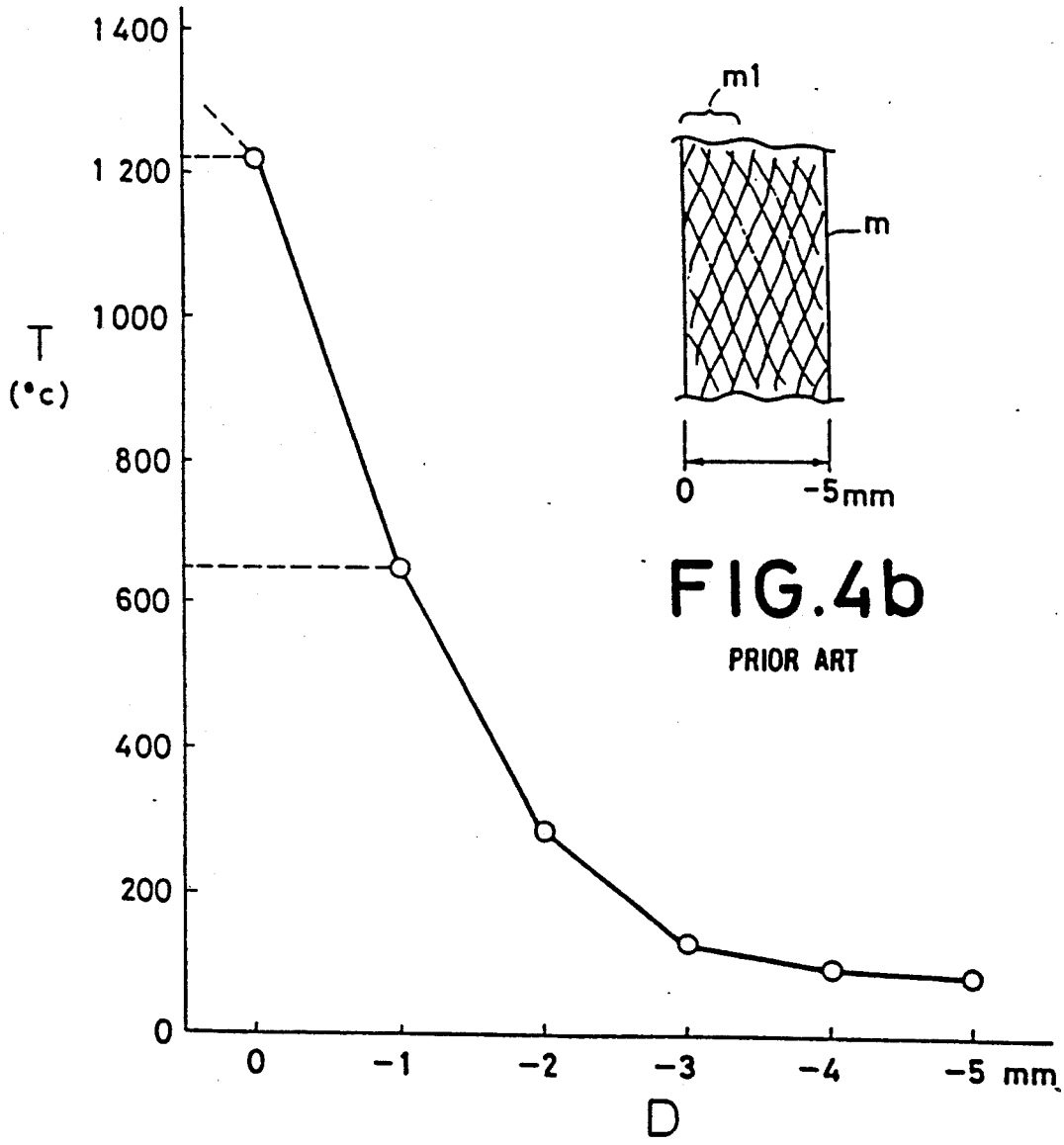
FIG.4b PRIOR ART
FIG.4a PRIOR ART
FIG. 4*a* is a graph showing a temperature distribution at the section of the stainless steel fiber mat in the conventional surface combustion burner, with the abscissa representing the internal depth position D[mm] of the burner diaphragm using the surface of the surface layer portion as the origin (O) and the ordinate representing the temperature T[°C.].
FIG. 4*b* is a schematic representation of a section of a stainless steel fiber mat showing the depth of the surface layer portion ml of the mat.

FIG. 2 shows the relation between the equivalent amount ratio $\phi$ of the gas-air mixture ( the actual fuel-air ratio/the stoichiometric fuel-air ratio ) in the surface combustion burner of the present embodiment and the boundary surface temperatures of the respective layers in the burner diaphragm M. In this case, the typical flow velocity of the mixture is selected to be 15 cm/sec and methane ($CH_4$) is selected as the fuel gas. The curve Tms represents the surface temperature of the $Al_2O_3$ ceramic cloth 1, the curve Tmb the temperature at the back of the $Al_2O_3$ ceramic cloth 1 or the temperature at the boundary surface between it and the stainless steel fiber mat 3, and Tmd the temperature at the boundary surface between the stainless steel fiber mats 2 and 3.

As shown in FIG. 2, in the burner diaphragm M of the present invention in which the $Al_2O_3$ ceramic cloth 1 is used in place of the portion which will be brought into a high-temperature red hot state with the progress of the gas combustion, the temperature at the boundary surface between the $Al_2O_3$ ceramic cloth 1 and the stainless steel fiber mat 3 can be maintained below 800° C. with respect to the various equivalent amount ratios $\phi$ and also the temperature at the boundary surface between the stainless steel fiber mats 2 and 3 can be maintained below about 600° C.

As a result, the progress of oxidation in the stainless steel fiber mats 2 and 3 is retarded so that in accordance with the present embodiment the burner diaphragm life can be increased up to 5000 hours even under the maximum load operation as compared with the conventional life of about 100 hours, whereas, even if the stitch pattern due to the sewing of the $Al_2O_3$ ceramic cloth 1 and the stainless steel fiber mat 3 is simply present at the combustion surface, the stainless steel fiber mats 2 and 3 are bonded by sintering so that there is no occurrence of the breaking out of a flame on the stitch pattern at the combustion surface during the operation and the uniformity of the surface combustion is improved.

It is to be noted that while, in the above-described embodiment, the stainless steel fiber mat and the $Al_2O_3$ ceramic cloth are sewed together with the Kanthal-wire thread, these materials may be selected and combined in various ways in consideration of the heat resisting properties and economy. For instance, it is possible to make various modifications such as using a $TiO_2$ ceramic cloth in place of the $Al_2O_3$ ceramic cloth, using a platinum wire in place of the Kanthal wire and so on.

I claim:

1. A surface combustion burner comprising a first layer of a material having a burning resisting property and forming a gas combustion zone, and a second layer for supplying a gas to said first layer and supporting said first layer, said burner further comprising:

a third layer arranged between said first and second layers, said third layer being bonded to said first layer by substantially continuous stitching with a burning resisting thread, and said third layer being bonded to said second layer by sintering.

2. A surface combustion burner as set forth in claim 1, wherein said first layer comprises a ceramic cloth.

3. A surface combustion burner as set forth in claim 1, wherein said burning resisting thread comprises a heat resisting metal wire, and that said first and third layers are sewed together with said heat resisting metal wire by a sewing machine.

4. A surface combustion burner as set forth in claim 3, wherein said substantially continuous stitching comprises a checkerboard pattern.

* * * * *